US005619021A

United States Patent [19]

Yamamoto et al.

[11] Patent Number: 5,619,021

[45] Date of Patent: Apr. 8, 1997

[54] LEVER SWITCH DEVICE, METHOD FOR ACTIVATING SWITCHES IN A LEVER SWITCH DEVICE, AND METHOD FOR OUTPUTTING DATA SIGNALS

[75] Inventors: Tetsuo Yamamoto; Yoshikazu Taniguchi, both of Yokkaichi, Japan

[73] Assignee: Sumitomo Wiring Systems, Ltd., Mie, Japan

[21] Appl. No.: 341,878

[22] Filed: Nov. 15, 1994

[30] Foreign Application Priority Data

| | | | |
|---|---|---|---|
| Nov. 19, 1993 | [JP] | Japan | 5-066837 |
| Nov. 19, 1993 | [JP] | Japan | 5-314568 |
| Nov. 19, 1993 | [JP] | Japan | 5-314569 |
| Nov. 19, 1993 | [JP] | Japan | 5-314572 |

[51] Int. Cl.[6] ..... H01H 25/04

[52] U.S. Cl. ..... 200/6 A

[58] Field of Search ..... 200/4, 5 R, 5 A, 200/6 R, 6 A, 17 R, 18, 61.85, 332, 335, 336, 339; 341/23, 24; 345/161

[56] References Cited

U.S. PATENT DOCUMENTS

| | | | |
|---|---|---|---|
| 4,052,578 | 10/1977 | Hoke | 200/153 L |
| 4,280,027 | 7/1981 | Comerford et al. | 200/6 A |
| 4,309,582 | 1/1982 | Coors | 200/153 T |
| 4,758,692 | 7/1988 | Roeser et al. | 200/6 A |
| 5,224,589 | 7/1993 | Karakama et al. | 200/339 |
| 5,227,594 | 7/1993 | Russo | 200/6 A |
| 5,313,027 | 5/1994 | Inoue et al. | 200/5 A |
| 5,459,292 | 10/1995 | Nagano et al. | 200/5 R |

FOREIGN PATENT DOCUMENTS

| | | | |
|---|---|---|---|
| 0246968 | 11/1987 | European Pat. Off. | H01H 25/04 |
| 0337045 | 10/1989 | European Pat. Off. | H01H 25/04 |
| 0348202 | 12/1989 | European Pat. Off. | H01H 25/04 |
| 1268251 | 5/1968 | Germany | H01H 25/04 |
| 2035283 | 2/1971 | Germany . | |
| 9201236.1 | 4/1992 | Germany | H01H 25/04 |
| 61-201244 | 12/1986 | Japan | H01H 25/06 |
| 2145502 | 3/1985 | United Kingdom | H01H 25/04 |

OTHER PUBLICATIONS

Barratt et al., "Joystick Controller for Pager Applications", Motorola Technical Developments, Feb. 1994, pp. 118–119.

*Primary Examiner*—Michael L. Gellner
*Assistant Examiner*—Michael A. Friedhofer
*Attorney, Agent, or Firm*—Oliff & Berridge

[57] ABSTRACT

A pressing operation while an operation lever is tilted is inhibited by causing an enlarged portion of the operation lever to butt against a stopper. A tilting operation while an operation lever is pressed is inhibited by causing the enlarged portion to butt against the stopper. Therefore, the two operations can not be concurrently performed so that a set switch and a select switch are inhibited from being simultaneously turned on. Furthermore, the operation lever is supported in a tiltable manner by forming support shafts and rotation shafts whose axes perpendicularly intersect each other. Even when foreign substances are trapped in rotation portions of the support shafts and the rotation shafts, therefore, there is little fear that the foreign substances will remain trapped between the mating or contacting portions, thereby ensuring that the operation lever can be tilted smoothly and returned to the neutral position. In addition, a switch matrix ensures that signals from adjacent switches are accurately processed. A switch element also ensures simultaneous activation of circuits to avoid transient signaling errors.

25 Claims, 9 Drawing Sheets

LEVER SWITCH DEVICE, METHOD FOR ACTIVATING SWITCHES IN A LEVER SWITCH DEVICE, AND METHOD FOR OUTPUTTING DATA SIGNALS

BACKGROUND OF THE INVENTION

This invention relates to a lever switch device in which a switch can be activated by pressing an operation lever in the longitudinal direction, or tilting the operation lever, and particularly to a multi-direction switch device that may be utilized as a so-called joystick or the like having a lever tiltable in multiple directions. The invention also relates to methods for activating and connecting switches.

A lever switch device is disclosed in Japanese Utility Model Publication (Kokai) No. SHO-61-201244. As shown in FIG. 1, the lever switch device comprises an operation lever 72. The operation lever 72 includes a substantially hemispherical rotor 73 that slidingly contacts a hemispherical guide face 71 of an upper hollow portion of a housing 70 so as to be rotatably guided. The rotor 73 also includes a sliding rod 74 that is slidably fitted into the rotor 73 so as to pass through the center of the rotor 73.

When a knob 75 at the upper end of the sliding rod 74 is pressed under the neutral state of the operation lever 72, an operation pin 76 is pressed down by the lower end of the sliding rod 74, whereby a switch 77 disposed under the operation pin 76 is activated. When the knob 75 is released, the operation lever 72 returns to the original state by a return spring 80.

When the operation lever 72 is tilted from the neutral state, the sliding rod 74 and the rotor 73 are rotated as an integral unit so that an operation pin 78 is pressed down by the outer edge of the lower face of the rotor 73, whereby a switch 79 disposed under the operation pin 78 is activated. When the operation lever 72 is released, the operation lever 72 is returned to the original state by a return spring 81.

In the structure of the prior art lever switch device, the sliding rod 74 and the rotor 73 can be rotated under the state where the knob 75 is pressed down by a pressing operation of the operation lever 72, and the knob 75 can be pressed down under the state where the sliding rod 74 and the rotor 73 are rotated integrally by a tilting operation of the operation lever 72. In other words, this conventional structure is not provided with means for preventing the operation lever 72 from being concurrently subjected to both the pressing and tilting operations.

Consequently, there may arise a case where the switch 77, which can be activated by a pressing operation, and the switch 79, which can be activated by a tilting operation, are simultaneously activated. As a result, circuits that operate in accordance with the activation state of the switches 77 and 79 may erroneously operate.

Further, in the conventional lever switch device, for guiding and supporting the operation lever 72 in a tiltable manner, the hemispherical outer face of the rotor unit 73 that supports the operation lever 72 passing therethrough, and the hemispherical guide face 71 of the housing 70 slidingly contact each other, so that the operation lever 72 is tilted about the center of the hemispherical face.

In such a device in which guiding and supporting are realized by causing hemispherical faces to slidingly contact each other over a wide area, foreign substances such as dust enter into the space between the hemispherical guide face 71 of the housing 70 and the hemispherical outer face of the rotor unit 73. The foreign substances cannot be easily discharged and remain trapped between the faces. When such a phenomenon happens, the load of operating the operation lever 72 is increased, and there may arise a problem in that, even when the operating force is removed, the operation lever fails to return to the neutral position.

A switch device of such a type is used in, for example, a controller of a car navigation system. For example, the device is used in such a manner that, a display state is changed by tilting a lever to the right side to scroll a map displayed on a monitor screen in the right direction, and by tilting the lever to the upper side to scroll the map in the upper direction.

In the switch device, a lever tiltable in multiple directions is provided, and a plurality of switches are arranged at regular intervals around the lever. When one of the switches is pressed by tilting the lever, the switch is activated to be ON.

The plurality of switches are interconnected into a matrix form as shown in FIG. 2, so as to constitute a switch matrix circuit, and the switch matrix circuit is connected to input terminals R1–R5 of a well-known remote control IC 1.

The remote control IC 1 has two output terminals T1 and T2 through which timing signals are output to the switch matrix circuit, and has a function of converting parallel signals that are input to the data input terminals R1–R5 in response to timing signals t1 and t2, into serial signals which are then output from a transmitting terminal (not shown). The switch matrix circuit applies parallel data to the data input terminals R1–R5 of the remote control IC 1 in accordance with the switch that is activated to be ON when the timing signals t1 and t2 are received. The relationship between a pressed switch and data bits is defined, for example, as shown in Table 1.

TABLE 1

| State of SW | t1 | t2 | d1 | d2 | d3 | d4 | d5 |
|---|---|---|---|---|---|---|---|
| Upper is ON | 1 | 0 | 1 | 0 | 0 | 0 | 0 |
| Right is ON | 1 | 0 | 0 | 1 | 0 | 0 | 0 |
| Lower is ON | 1 | 0 | 0 | 0 | 1 | 0 | 0 |
| Left is ON | 1 | 0 | 0 | 0 | 0 | 1 | 0 |
| Upper left is ON | 1 | 0 | 0 | 0 | 0 | 0 | 1 |
| Lower left is ON | 0 | 1 | 0 | 0 | 1 | 0 | 0 |
| Lower right is ON | 0 | 1 | 0 | 0 | 0 | 1 | 0 |
| Upper right is ON | 0 | 1 | 0 | 0 | 0 | 0 | 1 |

Table 1 shows that, in the case where the lever is tilted to the upper side and hence the switch positioned on the upper side is pressed, when the timing signal t1 is output from the timing signal output terminal T1, the switch matrix circuit outputs data "10000" to the input terminals R1–R5 of the remote control IC 1.

In a switch device of such a type, because the lever can be tilted in multiple directions, switches adjacent to each other may be simultaneously activated to be ON in some tilt directions of the lever.

In the conventional switch matrix circuit, the relationship between the group of switches that are activated to be ON and digital data applied to the remote control IC 1 is preset as shown in Table 1. Accordingly, for example, in the case where the switch on the upper side and the switch on the upper left side are simultaneously pressed, the switch matrix circuit outputs data "10001" when the timing signal t1 is output from the output terminal T1. As seen from Table 1, however, the data is not previously defined. As a result, the data code output through the transmitting terminal cannot be recognized and there occurs a phenomenon in which the map is not scrolled in any direction.

In the case where the switch on the upper side and the switch on the upper right side are simultaneously pressed, data "10000" is output when the timing signal t1 is output, and data "00001" is output when the timing signal t2 is output. Thus, the data code indicating that the switch on the upper side is pressed and the data code indicating that the switch on the upper right side is pressed are both output, so that it is impossible to determine which switch is pressed and hence the scroll direction is not determined.

In order to overcome the above-mentioned drawbacks, it may be contemplated that four switches are provided respectively on the upper, lower, left, and right directions of a switch lever. In such a construction, when switches on the upper and right sides are simultaneously pressed, data indicative of the upper right direction is output. However, in this construction, there exists an inevitable difference between the stroke for pressing each switch by tilting the lever in one of the upper, lower, left and right directions, and the stroke for simultaneously pressing two switches, for example, on the upper side and the upper right side by obliquely tilting the lever. This disadvantageously results in poor operability of the lever.

In the above described device, a switch element is configured by using a printed board. Such a switch element has a specific structure in which two stationary contacts are formed on the printed board by means of a print wiring technique, a rubber switch cover having an inverted-container shape is disposed on the printed board so as to cover the stationary contacts, and a movable short-circuit conductor made of, for example, electrically conductive rubber is disposed on the ceiling portion of the switch cover. In this configuration, when the switch cover is pressed by an operating unit of, for example, a push button-like shape, the movable short-circuit conductor makes contact with the two stationary contacts on the printed board to establish the electrical continuity between the stationary contacts.

When such a switch element is to be configured as a switch for simultaneously connecting one common line to, for example, two branch lines, or a 2-circuit switch as shown in FIG. 3, three stationary contacts 101*a*, 101*b*, and 101*c* are formed on the printed board, and a movable short-circuit conductor 102 having a size sufficient for covering the stationary contacts is disposed over the stationary contacts 101*a*, 101*b*, and 101*c*. A common line is connected to, for example, the stationary contact 101*b*, and branch lines are respectively connected to the other stationary contacts 101*a* and 101*c*.

Observation of the connecting operations of the switch circuits using the movable short-circuit conductor has shown that it is practically impossible to produce connections between the movable short-circuit conductor and the entire formation area of the stationary contacts at the exact same time. Usually, the contacting area gradually extends starting from a predetermined contact start area, depending on the structure of the operating unit or the like, to a contact terminate area. Consequently, the closing operation of the switch circuit of a stationary contact that is disposed in the vicinity of the contact start area is accomplished before that of the switch circuit of another stationary contact that is disposed in the vicinity of the contact terminate area, with the result that a time difference is produced in the closing operations of the switch circuits. In the configuration shown in FIG. 3, when the contacting area of the movable short-circuit conductor 102 gradually extends in the direction from the right side to the left side, for example, the electrical continuity between the stationary contacts 101*b* and 101*c* is first established, and the electrical continuity between the stationary contacts 101*b* and 101*a* is established with a slight time lag.

The time difference is further noticeable in the case where the operating unit is a lever supported in a tiltable manner and a movable contact is obliquely pressed in accordance with the tilting operation of the lever. Moreover, switch elements connected to a digital circuit cause data processing errors.

SUMMARY OF THE INVENTION

The invention has been conducted in view of the above-described problems. It is an object of the invention to provide a lever switch device in which an operation lever can be prevented from being concurrently subjected to both the pressing and tilting operations.

Another object of the invention is to provide a lever switch device in which the operation of an operation lever is prevented from being hindered by ingress of foreign substances.

Yet another object of the invention is to provide a multi-direction lever switch device in which, even when adjacent switches are simultaneously pressed, it is possible to determine which one is pressed while maintaining excellent operability of the lever.

Still another object of the invention is to provide a switch element and a switch device that includes plural switch circuits and can simultaneously make the switch circuits enter the connection state or disconnection state.

According to the first aspect of the invention, there is provided a lever switch device comprising an operation lever that can be subjected to a pressing operation and a tilting operation; first switch means activated by a pressing operation of the operation lever; and second switch means activated by a tilting operation of the operation lever. The lever switch device further comprises operation restricting means for allowing movement of the operation lever by only one of the pressing operation and the tilting operation, and for inhibiting the movement of the operation lever by concurrent operations including both the pressing operation and the tilting operation.

Further, the operation restricting means provides the operation lever with an enlarged portion that radially extends and is moved together with the operation lever, and provides a base for supporting the operation lever with a stopper to which the enlarged portion is closely disposed by initiating either of the pressing and tilting operations of the operation lever. Movement of the operation lever due to concurrent operations including both the pressing operation and the tilting operation is inhibited by making the enlarged portion butt against the stopper.

Furthermore, the operation lever is fitted into a tilting unit to pass therethrough, the tilting unit being supported in a tiltable manner, thereby allowing the operation lever to be subjected to the pressing operation. A portion where the operation lever is fitted into the tilting unit has a noncircular section shape.

In the structure of the lever switch device of the first aspect of the invention, when only one of the pressing operation and the tilting operation is to be conducted on the operation lever, the operation restricting means does not interfere with a movement of the operation lever due to the operation, with the result that only the switch corresponding to either the pressing operation or the tilting operation is activated.

When the tilting operation is attempted while the pressing operation is being conducted, when the pressing operation is attempted while the tilting operation is being conducted, or when both the pressing operation and the tilting operation are simultaneously attempted, movement of the operation lever is inhibited by the operation restricting means.

Further, when the pressing or tilting operation is being conducted, the enlarged portion is positioned very close to the stopper. When the tilting operation is attempted while the operation lever is being pressed, when the pressing operation is attempted while the operation lever is being tilted, or when pressing and tilting the operation lever are to be simultaneously attempted, movement of the enlarged portion is inhibited by causing the enlarged portion to butt against the stopper.

Furthermore, because the portion where the operation lever is fitted into the tilting unit has a noncircular shape, the operation lever cannot be rotated with respect to the tilting unit.

According to the second aspect of the invention, a lever switch device in which a switch is activated by tilting an operation lever from a neutral position, and the operation lever is supported by a bearing unit which is supported so as to be rotatable about a first shaft, in such a manner that the operation lever is tiltable about a second shaft which intersects the first shaft.

Furthermore, axes of the first and second shafts can intersect each other at right angles. The tilting unit may be supported on the bearing unit that is rotatable about the first shaft such that the tilting unit is tiltable about the second shaft, the operation lever may be supported on the tilting unit so as to pass through the tilting unit such that the operation lever is relatively movable in a direction perpendicular to the first and second shafts, and the operation lever can be pressed in a direction perpendicular to the first and second shafts.

Moreover, a portion where the operation lever passes through the tilting unit has a noncircular section shape.

In the structure of the lever switch device of the second aspect of the invention, when tilting the operation lever and the tilting direction intersects the first shaft, the operation lever and the bearing unit are tilted as an integral unit about the first shaft. When the tilting direction intersects the second shaft, the bearing unit does not rotate about the first shaft, and the operation lever is relatively tilted about the second shaft with respect to the bearing unit. When the tilting direction intersects both the first and second shafts, the bearing unit is rotated about the first shaft, and the operation lever is relatively rotated about the second shaft with respect to the bearing unit.

Further, because axes of the first and second shafts may intersect each other at right angles, the rotation direction of the bearing unit is perpendicular to that of the operation lever with respect to the bearing unit, and the center of the tilting operation of the operation lever coincides with the intersection of the axes of the two shafts. Furthermore, when the operation lever is pressed while being relatively moved with respect to the tilting unit, another switch, which is disposed in addition to the switch activated by the tilting operation, can be activated.

Moreover, because the portion where the operation lever passes through the tilting unit has a noncircular section shape, the operation lever cannot be rotated with respect to the tilting unit.

According to the third aspect of the invention, the multi-direction lever switch device of the invention includes a lever tiltable in multiple directions, and a switch matrix circuit including a plurality of switches that are activated in accordance with a tilt direction of the lever, the switch matrix circuit outputting digital data indicating one of the plurality switches that is activated in accordance with the tilt direction of the lever. The switch matrix circuit is constructed so that digital data is output based on a first set of switches despite activation of a second set of switches that are adjacent the first set of switches.

Each switch of the first set of switches may be a 2-circuit switch having two circuits and three contacts in which the two circuits are simultaneously opened or closed, and each switch of the second set is a 1-circuit switch having one circuit and two contacts, the two circuits of the 2-circuit switch being connected in parallel with the circuits of the 1-circuit switches, respectively. The first set of switches may each be assigned to a direction in which the switch is more frequently activated than the second set of switches corresponding to tilt directions adjacent to the one tilt direction.

Further, according to the fourth aspect of the invention, when a 2-circuit switch having two circuits and three contacts is pressed by tilting the lever, the two circuits are simultaneously activated to be ON. In this configuration, because the two circuits are connected in parallel to a circuit of a respective 1-circuit switch positioned on both sides thereof, the state where the 2-circuit and 3-contact switch is turned ON is the same as that where the 1-circuit switches positioned on both sides are simultaneously pressed.

According to the fifth aspect of the invention, a switch element is used for simultaneously connecting or disconnecting one common line to or from plural branch lines. Plural stationary contacts are arranged on a common plane and a movable short-circuit conductor is opposed to the stationary contacts. A connection between the movable short-circuit conductor and the stationary contacts progresses in a sequence from a predetermined contact start area to a predetermined contact terminate area. One of the stationary contacts connected to the common line is disposed in the contact terminate area, and the other stationary contacts that are connected to the branch lines are disposed in an area other than the area in which the stationary contact connected to the common line is disposed.

The stationary contacts connected to the branch lines may be dividedly disposed so as to be on both sides of a line that extends from the contact start area to the contact terminate area.

Further, the switch device has a lever tiltable in multiple directions, and switch elements that are arranged around an axis of the lever to be activated in accordance with a tilt direction of the lever.

In the structure of the lever switch device, switch circuits are configured between the common line and the branch lines separated from the common line, one stationary contact is connected to the common line, and the other stationary contacts are respectively connected to the branch lines. The one stationary contact and the other stationary contacts are short-circuited by the movable short-circuit conductor to place the switch circuits in the connection state.

In the above, the connection between the movable short-circuit conductor and the formation areas of the stationary contacts may gradually progress in the sequence from the contact start area to the contact terminate area. Because the stationary contact connected to the common line is disposed in the contact terminate area with which the movable short-circuit conductor finally makes contact, the other stationary contacts connected to the branch lines are first short-circuited by the movable short-circuit conductor. Thereafter, the other short-circuited stationary contacts, and the one stationary contact connected to the common line are short-circuited, resulting in that the connections between the common line and the branch lines are simultaneously established.

The stationary contacts are dividedly disposed so as to be on both sides of a line that extends from the contact start area to the contact terminate area, and hence the stationary contacts make contact with the movable short-circuit conductor at the same time.

The switch elements are activated in accordance with a tilting operation of the lever, and therefore there may arise a problem in that the times at which the movable short-circuit conductor makes contact with the stationary contacts are liable to be scattered. According to the above configuration, however, the short-circuit state between the stationary contacts of the branch lines is first established, and thereafter the stationary contacts make contact with the stationary contact of the common line. As a result, the common line and the branch lines are simultaneously connected to each other.

As described above, according to the first aspect of the invention, when attempting 1) tilting during pressing; 2) pressing during tilting is; or 3) simultaneous pressing and tilting, movement of the operation lever due to the operation(s) is inhibited by the operation restricting means. Therefore the pressing operation and the tilting operation cannot be conducted concurrently. This attains the effect that attempts at simultaneous activation of tilting and pressing the switches is prevented from being simultaneously activated and erroneous operation due to concurrent operations of plural switches can be avoided.

Further, the tilting operation during the pressing operation, the pressing operation during the tilting operation, and the concurrent pressing and tilting operations are inhibited by the common stopper. As compared with a structure in which these inhibiting functions are respectively realized by different stoppers, the cost and the space can be reduced.

Furthermore, because the operation lever cannot be rotated with respect to the tilting unit, an operation error such as unintentionally rotating the operation lever in a wrong direction can be prevented. Moreover, when marks such as those indicative of the tilting directions may be formed on the operation lever, the operability can be improved.

As described above, according to the second aspect of the invention, the operation lever is supported by the first and second shafts that intersect each other. Consequently, unlike a prior art lever switch device in which wide hemispherical faces are caused to make slidingly contact with each other, even when foreign substances enter the shaft portions and are sandwiched therein, there is little fear that the foreign substances will remain sandwiched therein for a long period of time because they are quickly discharged. Consequently, the operation lever can be tilted smoothly, and the operation lever is rarely hindered from returning to the neutral position.

As described above, according to the multi-direction lever switch of the third aspect of the invention, even when adjacent switches are simultaneously activated, it is judged that only one of the switches is pressed. Accordingly, abnormal operation is prevented. In addition, the strokes in respective directions can be set in a similar way, so that it is possible to improve the operability of the lever.

As described above, according to the switch element of the fourth aspect of the invention and the switch device having the same, stationary contacts connected to branch lines are short-circuited, and the connection or disconnection between the stationary contacts and a stationary contact connected to a common line is performed. Therefore, all switch circuits simultaneously made enter the contacting or disconnecting state, thereby eliminating timing differences from occurring in a circuit or the like wherein all switch circuits must enter the contacting or disconnecting state, be connected to a branch line, or operate at the exact same time.

Further objects, features and advantages of the present invention will become apparent from the detailed description of preferred embodiments which follows, when considered together with the attached figures of drawings.

DETAILED DESCRIPTION OF PREFERRED EMBODIMENTS

Figure 1:
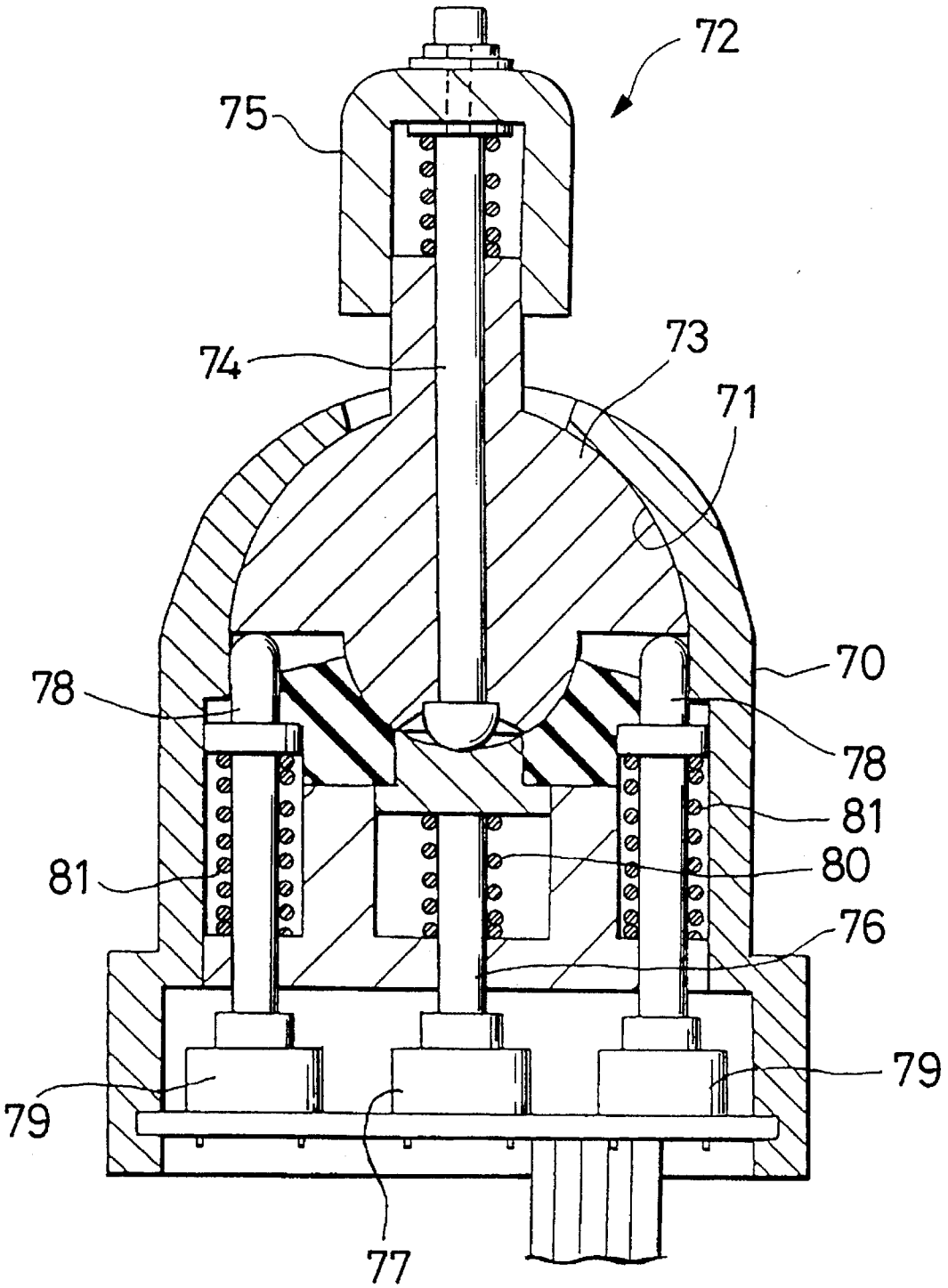
FIG. 1 PRIOR ART
FIG. 1 is a cross section view of a conventional lever switch device.
Figure 2:
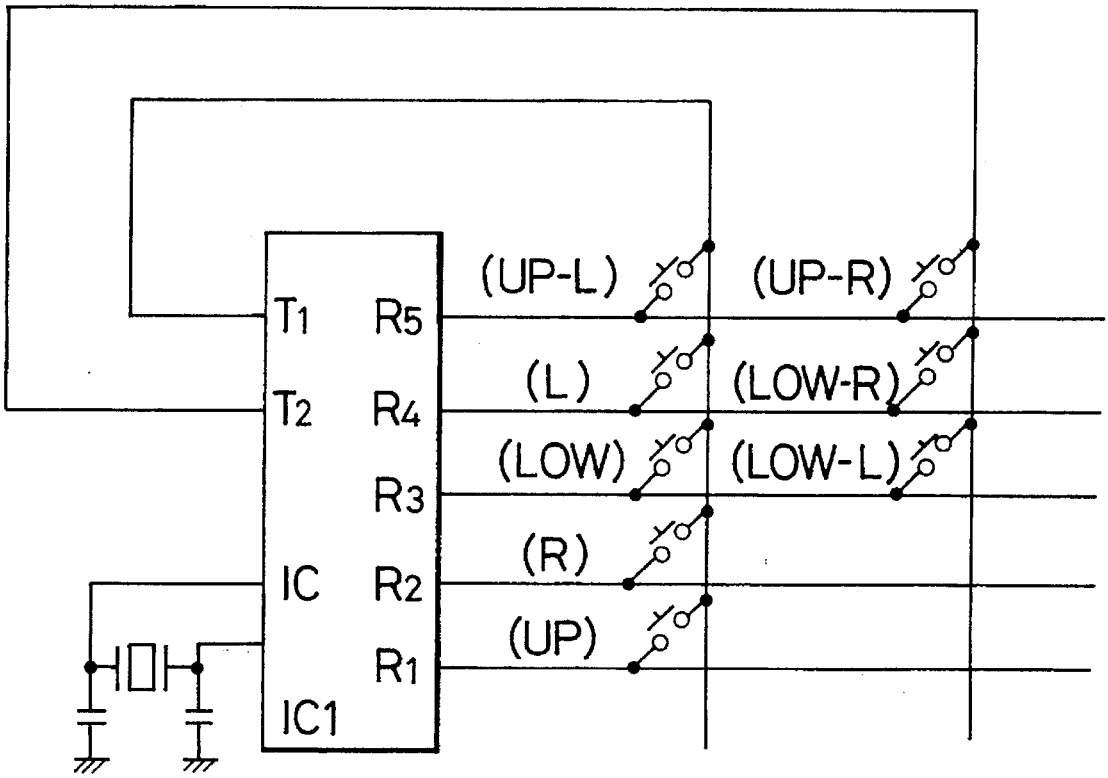
FIG. 2 PRIOR ART
FIG. 2 is a circuit diagram showing a conventional switch matrix circuit.
Figure 3:
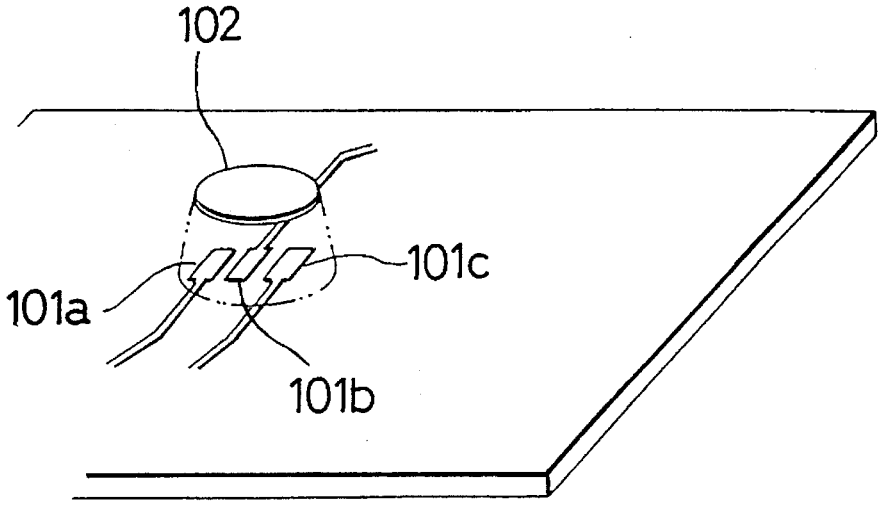
FIG. 3 PRIOR ART
FIG. 3 is a perspective view diagrammatically showing a prior art switch element.
Figure 4:
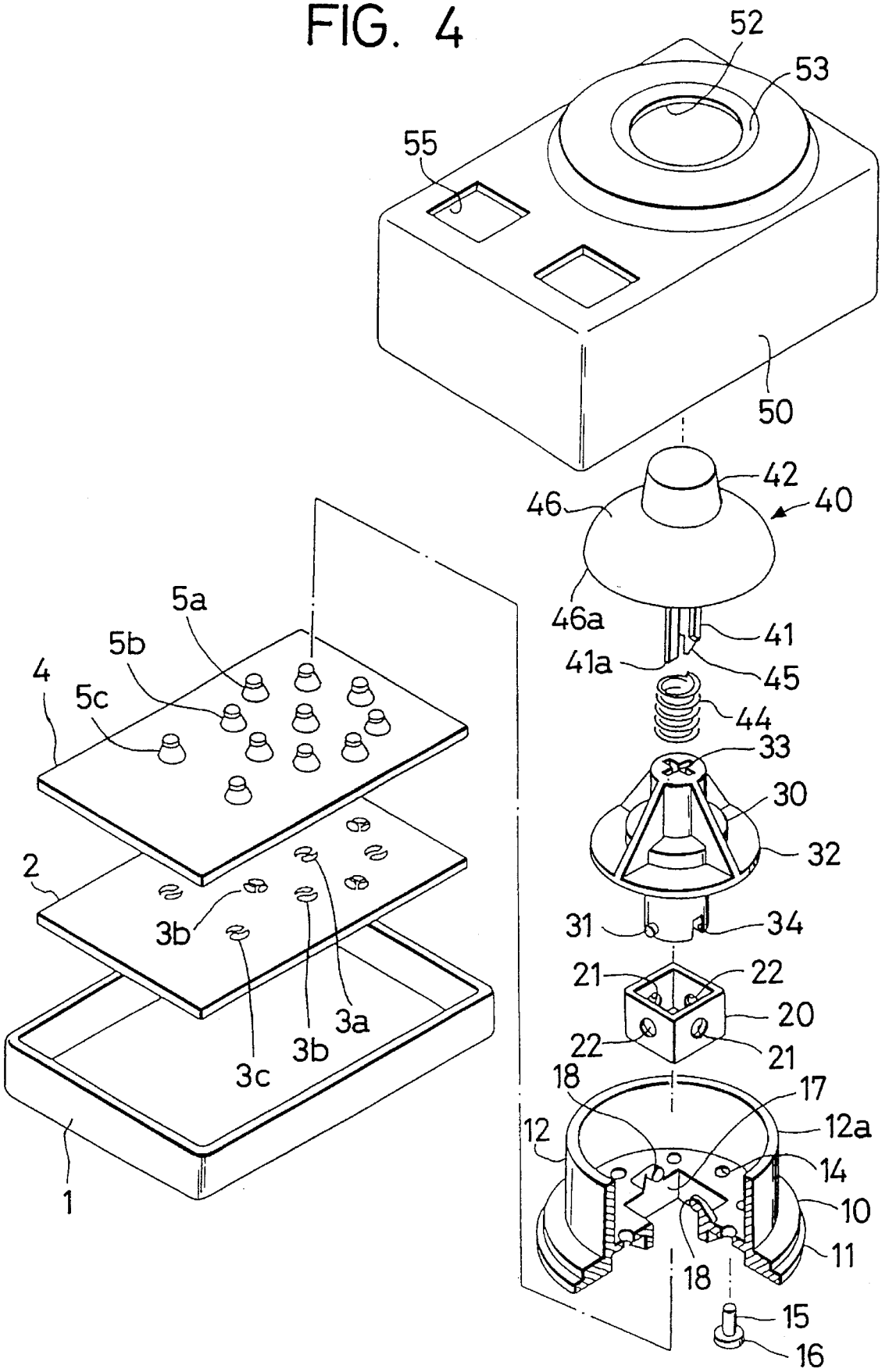
FIG. 4 is an exploded perspective view showing an embodiment of the invention.

Hereinafter, an embodiment of the invention will be described with reference to FIGS. 4 to 7.

In a square case 1 in the form of a shallow tray, a square printed board 2 is fixed. Circuit components such as ICs (for example, a remote control IC for an infrared-ray remote control transmitter), transistors, resistors, and capacitors are mounted on the back side of the printed board. On the surface of the printed board 2, a pair of stationary contacts 3*a* for a set switch are disposed, and eight pairs of stationary contacts 3*b* for select switches are arranged at regular angular intervals of 45 degrees on a circle having the center at the stationary contacts 3*a* for the set switch.

A switch cover 4 made of rubber having electric insulating property and elasticity is fixedly attached to the printed board 2. The switch cover 4 has as a whole a shape of a square thin plate that can cover the entire face of the printed board 2. Switch operating units 5*a* and 5*b* are formed at a total of nine positions respectively corresponding to the pair of stationary contacts 3*a* for the set switch and the eight pairs of stationary contacts 3*b* for the select switches. The switch operating units 5*a* and 5*b* protrude in such a manner that they are usually separated from the surface of the printed board 2.

Each of the switch operating units 5*a* and 5*b* includes a thin elastic rising portion 6*a* or 6*b*, and a circular top portion 7*a* or 7*b* positioned at the protrusion end of the elastic rising portion 6*a* or 6*b*. The elastic rising portion 6*a* or 6*b* rises from the surface of the switch cover 4 in a tapered cone shape so as to surround the stationary contacts 3*a* or 3*b*. A disk-like movable short-circuit conductor 8*a* or 8*b* made of an electrically conductive rubber material is fixed to the back side of the top portion 7*a* or 7*b*. Usually, the switch operating units 5*a* and 5*b* are in the non-operating state in which the elastic rising portions 6*a* and 6*b* rise to separate the movable short-circuit conductors 8*a* and 8*b* from the stationary contacts 3*a* and 3*b*. When the top portion 7*a* or 7*b* is pressed, the movable short-circuit conductor 8*a* or 8*b* is brought into contact with the respective pair of the stationary contacts 3*a* or 3*b*, while elastically deforming the elastic rising portion 6*a* or 6*b*, whereby the electrical continuity is established between respective stationary contacts 3*a* or 3*b*. When the pressure on the top portion 7*a* or 7*b* is released, the non-operating state is restored in which the movable short-circuit conductor 8*a* or 8*b* is separated from the stationary contacts 3*a* or 3*b* due to the elastic restoring force of the elastic rising portion 6*a* or 6*b*.

As described above, one set switch $SW_A$ is configured by a stationary contact 3*a*, a switch operating unit 5*a*, and a movable short-circuit conductor 8*a*. Each of the eight select switches $SW_B$ comprises a stationary contact 3*b*, a switch operating unit 5*b*, and a movable short-circuit conductor 8*b*.

A circular base 10 is fixed to the surface of the switch cover 4 in such a manner that its periphery is positioned by a pressing portion 51 of a cover 50, which will be described later. The base 10 is concentric with the circle on which the eight select switches $SW_B$ are arranged and which is centered at the set switch $SW_A$. A cylindrical stopper 12 having a diameter greater than the circle of the select switches $SW_B$ is formed on a surface of a bottom plate 11 of the base 10.

On the bottom plate 11 of the base 10, recess portions 13 for avoiding the interference with the respective switch operating units 5*b* are formed at eight positions corresponding to the select switches $SW_B$, by making recesses in the back face of the bottom plate 11. Guide holes 14 extend from the hollow of each recess portion 13 to the upper face of the bottom plate 11. An operation pin 15 having an engaging flange 16 at its base end is fitted into each of the guide holes 14 in such a manner that the tip end protrudes from the surface of the bottom plate 11 and the operation pin 15 can freely move in a direction perpendicular to the printed board 2. In a usual state, the operation pin 15 is pressed by the top portion 7*a* or 7*b* of the switch operating unit 5*a* or 5*b* due to the elastic restoring force of the elastic rising portion 6*a* or 6*b*. Hence, the operation pin is kept in a state wherein the engaging flange 16 is pressed against the innermost face of the recess portion 13 and the tip end of the pin normally protrudes upwardly to the extent allowed by the flange 16.

At the center of the bottom plate 11, a square through hole 17 is opened so as to surround the set switch $SW_A$. Coaxial support shafts 18 are formed on the periphery in the surface side of the through hole 17 so as to respectively protrude from two parallel edges of the through hole's periphery to the inside of the through hole 17. On the printed board 2, the common axis of the two support shafts 18 is parallel into the line passing the center of the circle of the eight select switches $SW_B$.

A square cylinder-like bearing unit 20 is rotatably supported on the thus configured base 10 by fittingly inserting the support shafts 18 of the through hole 17 into coaxial bearing holes 21 formed in two parallel faces of the bearing unit 20. Coaxial shaft fitting holes 22 are formed in the other two parallel faces of the bearing unit 20 in which the bearing holes 21 are not formed. The common axis of the two shaft fitting holes 22 intersects the axis of the support shafts 18 at right angles in a plane parallel to the face of the printed board 2. The intersection of these axes coincides with the center of the circle of the eight select switches $SW_B$.

A tilting unit 30 including an outer periphery that has a circular rod-like shape and a tip end that protrudes from the stopper 12 of the base 10, is rotatably supported on the thus configured bearing unit 20 by fittingly inserting rotation shafts 31 protruding from the tilting unit's base end into the shaft fitting holes 22. Because the tilting unit 30 is supported by the support shafts 18 and rotation shafts 31, which intersect each other at right angles, the tilting unit 30 can be tilted in any desired direction with respect to the base 10 about the intersection of the shafts 18 and 31 while the neutral posture perpendicular to the printed board 2 is set as the reference.

A flange 32 is formed on the outer periphery of the tilting unit 30. In the neutral state wherein the tilting unit 30 is perpendicular to the printed board 2, the flange 32 simultaneously butts against all the tip ends of the eight operation pins 15 fitted into the base 10. As described above, the operation pins 15 are urged in the protrusion direction by the elastic restoring force of the switch operating units 5*a* and 5*b*, and therefore all the operation pins 15 usually butt against the tilting unit 30 so as to exert a pressure that is uniform in the peripheral direction, whereby the tilting unit 30 is kept in the neutral state.

When the tilting unit 30 is tilted, one (or two) of the eight operation pins 15 is pressed by the flange 32 to be retracted toward the recess portion 13, and the switch operating unit 5*b* butting against the pressed operation pin 15 is moved to the side closer to the printed board 2 against the elasticity of the elastic rising portion 6*b*. When the tilting force acting on the tilting unit 30 is canceled, the operation pin 15 is returned by the elastic restoring force of the elastic rising portion 6*b* so that the tilting unit 30 is returned to the neural state.

Through the tilting unit 30, supporting hole 33 that extends from the top end face to the base end face along the longitudinal direction of the supporting hole 33. The supporting hole 33 has a cruciform section. At the base end of the tilting unit 30, a notch 34 is formed so as to extend from the outer periphery to the inner face of the supporting hole 33.

A cruciform-section leg portion 41 of an operation lever 40 in which a tapered cylinder-like knob portion 42 is formed at the tip end of the leg portion 41 is fitted into the supporting hole 33 of the thus configured tilting unit 30. Accordingly, the operation lever 40 is supported on the tilting unit 30 in such a manner that it can be freely moved in the longitudinal direction of the leg portion 41 and cannot be rotated about an axis along the longitudinal direction. The operation lever 40 and the tilting unit 30 can be tilted as an integral unit.

The operation lever 40 is constantly urged in the protrusion direction toward the tip end by a return spring 44, for example, a compression coil spring, that is fitted onto the leg portion 41 and between a spring bracket 43 on the inner periphery of the knob portion 42 and the front end face of the tilting unit 30. Usually, the operation lever 40 is kept in the non-operating state wherein an engaging portion 45 formed at the base end of the leg portion 41 is engaged with the notch 34 of the tilting unit 30.

A base end face 41*a* of the leg portion 41, which is in the non-operating state, is opposed to the top portion 7*a* of the switch operating unit 5*a* of the set switch $SW_A$, with a predetermined gap therebetween. When the operation lever 40 is moved against the urging force of the return spring 44 in the direction along which the leg portion 41 is pressingly inserted into the tilting unit 30, the base end face 41*a* of the leg portion 41 butts against the top portion 7*a* of the switch operating unit 5*a* to press it toward the printed board 2.

An enlarged portion 46 is formed on the operation lever 40 by extending the knob portion 42 toward the base 10 so as to have an umbrella-like shape. The outer face of the enlarged portion 46 is configured as a spherical face centered at the intersection of the axes of the support shafts 18 and the rotation shafts 31. When the operation lever 40 is perpendicular to the printed board 2 or in the neutral state and in the non-operating state, an end face 46*a* of the outer peripheral edge of the enlarged portion 46 is opposed at the whole of its periphery to a front end face 12*a* of the stopper 12 of the base 10, with a predetermined uniform gap therebetween. The gap between the enlarged portion 46 and the stopper 12 in this case is slightly greater than a total of the gap between the base end face 41*a* of the leg portion 41 of the operation lever 40 and the top portion 7*a* of the switch operating unit 5*a*, and that between the movable short-circuit conductor 8*a* of the top portion 7*a* and the stationary contacts 3*a* for the set switch on the printed board 2.

The enlarged portion 46 and the stopper 12 constitute operation restricting means 9 that, as described later in detail, has a function of preventing the set switch $SW_A$ and the select switch $SW_B$ from being simultaneously activated.

The enlarged portion 46 of the operation lever 40, and the stopper 12 constitute operation restricting means 9. As described later, the operation restricting means 9 inhibits the operation lever 40 from being operated so as to cause the set switch $SW_A$ and the select switch $SW_B$ to be simultaneously turned on, thereby preventing mechanisms that operate in accordance with the activation state of the switches $SW_A$ and $SW_B$ from erroneously operating.

A cover 50 is fixed to the case 1 so as to cover the above-described components. In the front face of the cover 50, formed is a circular window hole 52 that is concentric with the base 10 and has a diameter larger than the knob portion 42 of the operation lever 40. The knob portion 42 is exposed through the window hole 52. A tapered portion 53 elongates from the edge of the window hole 52 in a conical shape so as to oppose the outer face of the enlarged portion 46 while forming a small gap therebetween.

Figure 5:
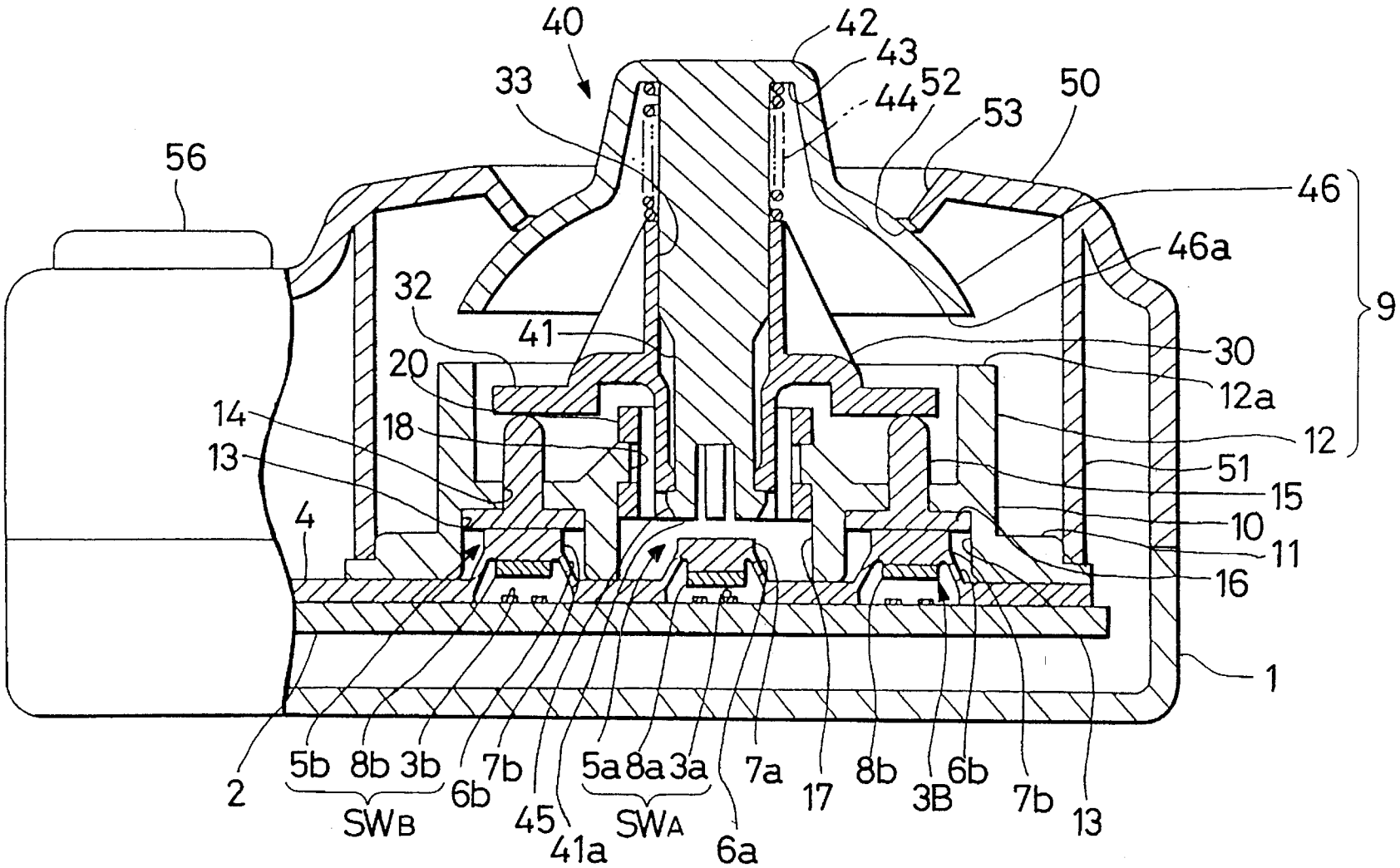
FIG. 5 is a cross section view showing a non-operating state.

The operation of the thus configured lever switch device will now be described. As shown in FIG. 5, the operation lever 40 is usually in the OFF state wherein the set switch $SW_A$ and the eight select switches $SW_B$ are opened.

Figure 7:
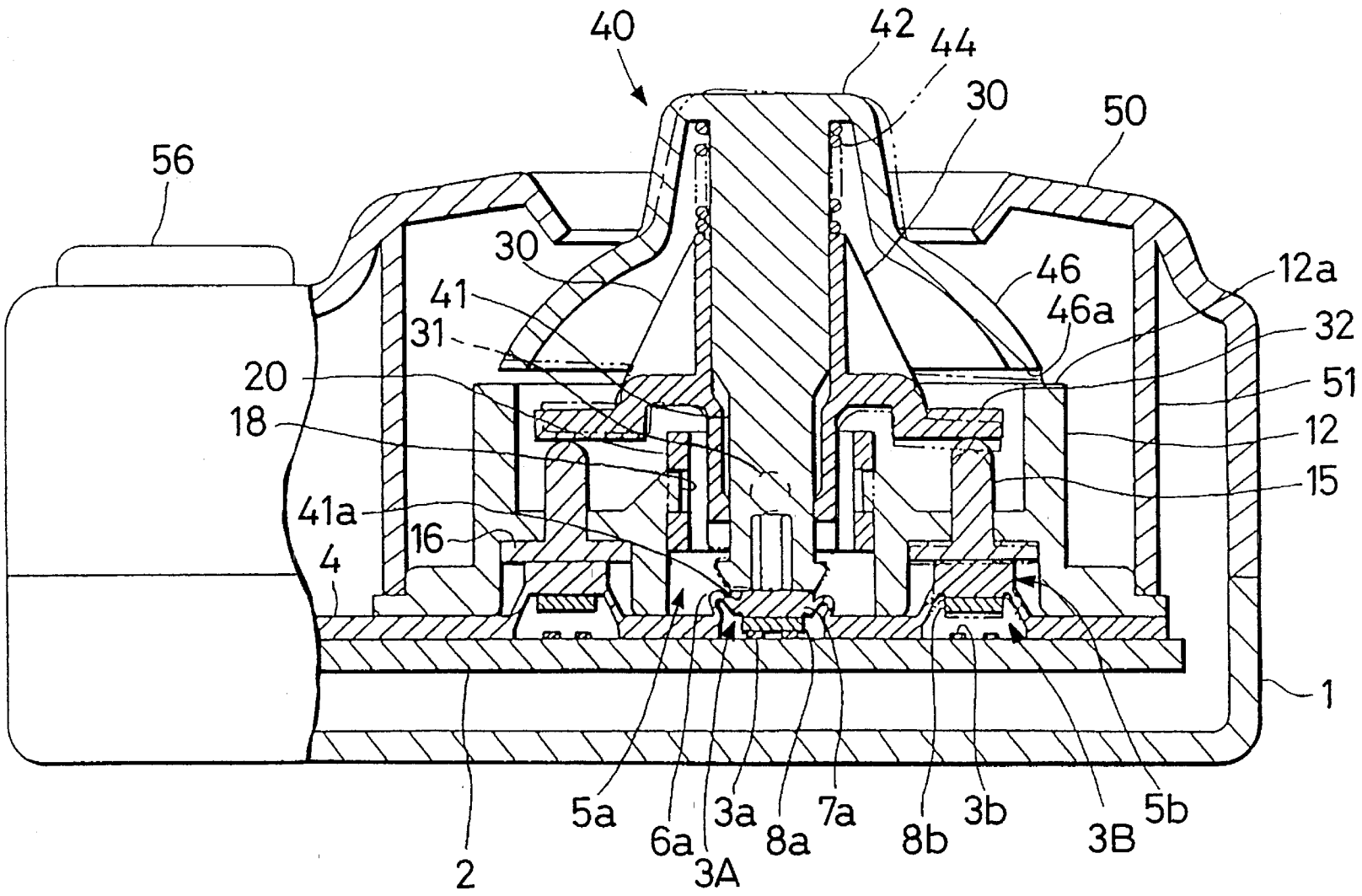
FIG. 7 is a cross section view showing a state where an operation lever is pressed.

Under this state, when the knob portion 42 of the operation lever 40 is grasped to be pressed down against the urging force of the return spring 44, the base end face 41*a* of the leg portion 41 of the lever presses the top portion 7*a* toward the printed board 2 while elastically deforming the elastic rising portion 6*a* of the switch operating unit 5*a*. This causes the movable short-circuit conductor 8*a* of the top portion to contact the stationary contacts 3*a* for the set switch as shown in FIG. 7. Accordingly, electric continuity is established between the stationary contacts 3*a*, and the set switch $SW_A$ enters the ON state. When the operation lever 40 is released, the operation lever 40 is returned to the non-operating state by the return spring 44. At the same time, the switch operating unit 5*a* is returned to the non-operating state by the elastic restoring force of the elastic rising portion 6*a*, and the movable short-circuit conductor 8*a* is separated from the stationary contacts 3*a* for the set switch, whereby the set switch $SW_A$ is turned to the OFF position.

Figure 6:
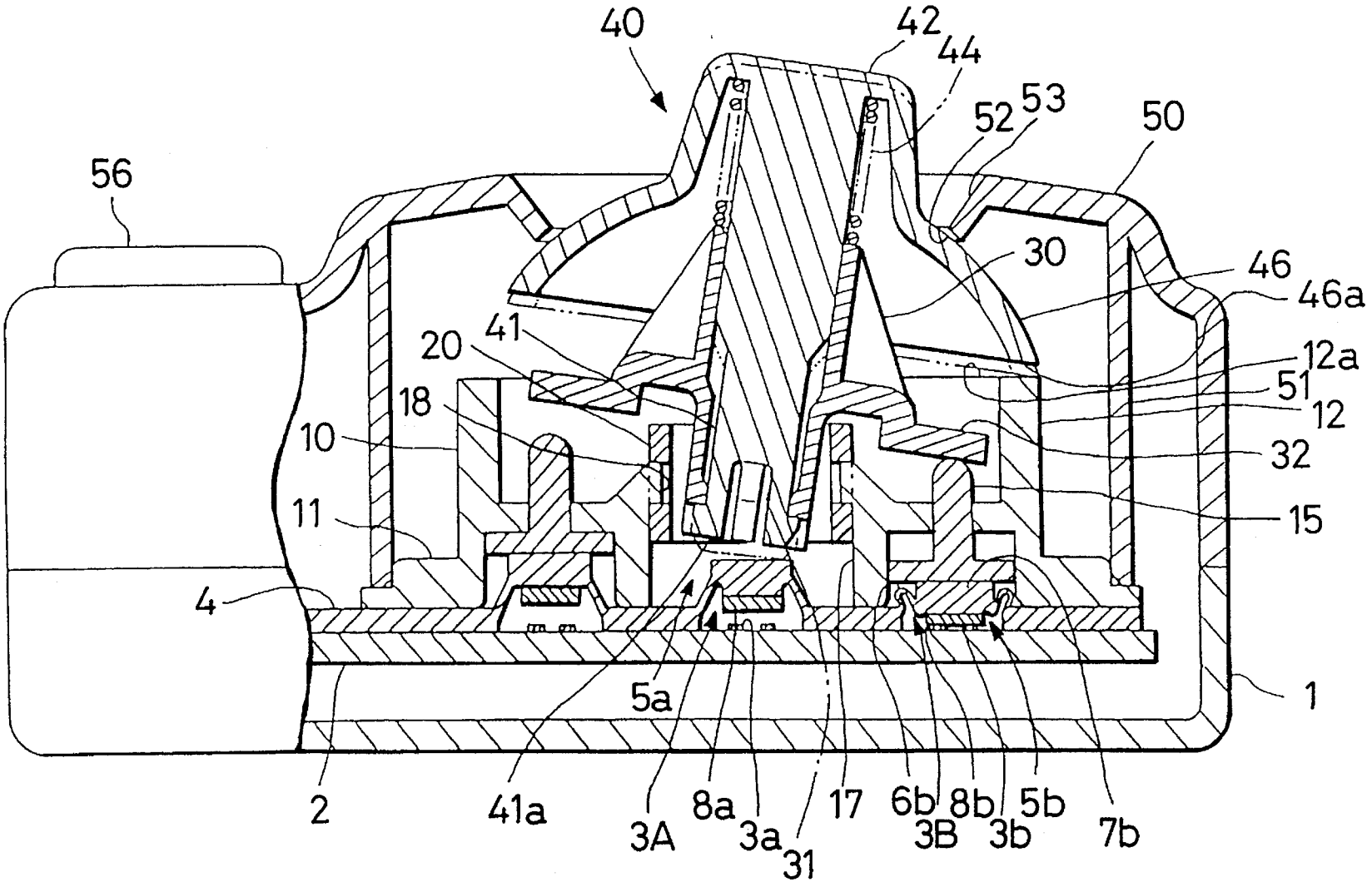
FIG. 6 is a cross section view showing a state where an operation lever is tilted.

When the knob portion 42 of the operation lever 40 in the neutral state is tilted in any desired one of the eight directions, the operation lever 40 and the tilting unit 30 are tilted as an integral unit so that the operation pin 15 positioned in the direction tilted is pressed down by the flange 32. As shown in FIG. 6, the movable short-circuit conductor 8*b* of the switch operating unit 5*b*, which is pressed to be elastically deformed by the operation pin 15, makes contact with the stationary contacts 3*b* for the select switch, so that electric continuity is established between the stationary contacts 3*b*, and the select switch $SW_B$ is switched ON. When the knob portion 42 of the operation lever 40 in this state is released, the tilting unit 30 and the operation lever 40 are returned from the tilting posture to the neutral state by the elastic restoring force of the switch operating unit 5*b*, and the movable short-circuit conductors 8*b* of the switch operating unit 5*b*, which is elastically returned, are separated from the stationary contacts 3*b* for the select switch, whereby the select switch $SW_B$ is switched to the OFF position.

This operation is conducted by moving the knob portion 42 of the operation lever 40 in any one of the eight directions while grasping the knob portion. When the moving direction is perpendicular to the axis of the support shafts 18 of the base 10, the bearing unit 20 and the tilting unit 30 are not relatively rotated about the rotation shafts 31, and the operation lever 40, the tilting unit 30 and the bearing unit 20 are tilted as an integral unit about the support shafts 18 with respect to the base 10.

When the moving direction of the knob portion 42 is perpendicular to the axis of the rotation shafts 31 of the tilting unit 30, the bearing unit 20 is not rotated about the support shafts 18 with respect to the base 10, and the operation lever 40 and the tilting unit 30 are tilted as an integral unit about the rotation shafts 31 with respect to the base 10 and the bearing unit 20.

When the angle formed by the moving direction of the knob portion 42 and the axes of the support shafts 18 and the rotation shafts 31 is 45 degrees, the operation lever 40 and the tilting unit 30 are tilted as an integral unit with respect to the base 10, while the bearing unit 20 is rotated about the support shafts 18 with respect to the base 10 and the tilting unit 30 is relatively rotated about the rotation shafts 31 with respect to the rotating bearing unit 20.

In all tilting operations, the center of the operation lever 40 and the tilting unit 30 coincides with the intersection of the axes of the support shafts 18 and the rotation shafts 31.

When the operation lever 40 is tilted, the outer face of the enlarged portion 46 does not interfere with the tapered portion 53 of the cover 50 because it is a spherical face that is concentric with the tilting center of the lever. During the tilting operation of the operation lever 40, because the enlarged portion 46 and the tapered portion 53 are always separated from each other only by a small constant gap, there is little fear that foreign substances will enter the inner space through the gap.

When the pressing operation is attempted while the operation lever 40 is tilted and the select switch $SW_B$ is turned on, the end face 46*a* of the outer peripheral edge of the enlarged portion 46 butts against the end face 12*a* of the stopper 12, as shown by the chain line in FIG. 6, before the base end face 41*a* of the leg portion 41 causes the switch operating unit 5*a*, elastically deform. Consequently, the operation lever 40 cannot be further pressed down, and hence the set switch $SW_A$ will not be turned on.

When the tilting operation is attempted while the operation lever 40 is pressed and the set switch $SW_A$ is turned on, the end face 46*a* of the enlarged portion 46 butts against the end face 12*a* of the stopper 12, as shown by the chain line in FIG. 7, at the instance when the switch operating unit 5*b* pressed by the flange 32 is elastically deformed to a small degree, which is not sufficient for making the movable short-circuit conductor 8*b* of the switch operating unit contact the stationary contacts 3*b* for the select switch. Consequently, the operation lever 40 cannot further be tilted, and hence the select switch $SW_B$ will not be turned on.

In this way, according to the embodiment, the set switch $SW_A$ and the select switch $SW_B$ are not simultaneously made to enter the ON state, and therefore erroneous operation due to concurrent ON operations of the two switches $SW_A$ and $SW_B$ can be surely prevented from occurring.

As described above, in order to guide the tilt of the operation lever 40, the configuration wherein the operation lever 40 is rotated about the support shafts 18 and the rotation shafts 31, which perpendicularly intersect each other, is employed in place of a prior art one wherein hemispherical faces are caused to make contact with each other over a wide area. Because the support shafts 18 have a small diameter, the contacting area between the shafts and the bearing holes 21 is small. Furthermore, the rotation shafts 31 have a small diameter, and hence the contacting area between the shafts and the shaft fitting holes 22 is small. Even when foreign substances such as dust enter the inner space of the operating mechanism, therefore, there is little fear that such foreign substances are trapped between the support shafts 18 and the bearing holes 21 or the rotation shafts 31 and the shaft fitting holes 22. Even when foreign substances enter into a gap between the support shafts 18 and the bearing holes 21 or that between the rotation shafts 31 and the shaft fitting holes 22, these foreign substances can be discharged in a relatively short period, and hence there is little fear that the foreign substances will adversely affect movement for a long period. In this way, because the phenomenon hardly occurs that the rotation of the operation lever 40 about the support shafts 18 and the rotation shafts 31 is hindered from being smoothly conducted, it is ensured that the operation lever 40 is smoothly tilted, and also that, when the tilting operation of the operation lever 40 is canceled, the operation lever 40 is returned to the neutral position.

In the embodiment, the supporting hole 33 of the tilting unit 30, and the leg portion 41 of the operation lever 40 to be fitted into the hole have a cruciform section shape so that the operation lever 40 cannot be rotated with respect to the tilting unit 30. Accordingly, there is no fear of an erroneous operation, such as unintentionally rotating the knob 42 to tilt the operation lever 40 in a wrong direction.

In addition to the stationary contacts 3*a* for the set switch and the stationary contacts 3*b* for the select switches, two pairs of stationary contacts 3*c* for operation switches are formed on the printed board 2. In accordance with the pressing or releasing operation conducted on operation buttons 56 that are exposed through window holes 55 of the cover 50, movable short-circuit conductors (not shown) formed on switch operating units 5*c* of the switch cover 4 make contact with or are separated from the stationary contacts 3*c*, whereby the operation switches are turned on or off.

The invention, however, is not restricted to the above-described embodiment. For example, the invention may be modified in the following manner:

(A) Switches that are turned on or off by the pressing or tilting operation of an operation lever are not restricted to the switch element of the embodiment, and include switch elements of other types such as a tact switch.

(B) Eight switches arranged in an annular area has been described. The invention can be applied also to a case where the number of switches is greater or smaller than 8.

(C) The supporting hole 33 of the tilting unit 30, and the leg portion 41 of the operation lever 40 to be fitted into the hole are formed to have a cruciform section shape so that the operation lever 40 is inhibited from being rotated with respect to the tilting unit 30. The invention can also be applied to a case where the supporting hole and the leg portion have a noncircular section shape other than a cruciform shape. In a case where it is not necessary to render the operation lever nonrotatable with respect to the tilting unit, the invention can be applied to a configuration in which the supporting hole and the leg portion have a circular section shape.

(D) The switch operating units 5*b* of the select switches $SW_B$ may be modified so that the pressing force required for the elastic deformation suddenly reduces when the switch operating units 5*b* are elastically deformed and the deformation amount exceeds a given value. In this alternative, the operator can get a tactile feel (clicking feel) when the operation lever 40 is tilted. Therefore, excellent operability is attained and erroneous operation rarely occurs.

(E) The pressing force required for the elastic deformation of the switch operating unit 5*a* may be modified to be set to a low level when the operation lever 40 is pressed to turn the set switch $SW_A$ ON. According to this configuration, the phenomenon that the load of the pressing operation of the operation lever 40 is suddenly increased when the base end face 41*a* of the leg portion 41 butts against the top portion 7*a* of the switch operating unit 5*a* can be prevented from occurring, thereby attaining excellent operability.

(F) Because the operation lever 40 cannot be rotated, marks such as those indicative of the tilting directions may be formed in front of the knob portion 42 of the operation lever 40. When such marks are formed, it is possible to indicate the tilting directions or the like, and hence the operability is further improved.

(G) The stopper has been described as formed on the base and the enlarged portion formed on the operation lever. The operation restricting means, which is an element constituting part of the present invention, is not restricted to this arrangement. For example, operation restricting means for inhibiting the tilting operation during the pressing operation, for inhibiting the pressing operation during the tilting operation and for inhibiting simultaneously tilting and pressing operations can be separately disposed.

(H) The set switch $SW_A$ that is turned on or off by conducting the pressing operation on the operation lever 40 has been described. The invention may be applied also to a device in which a switch corresponding to the set switch of the embodiment is not centrally disposed and an operation lever can be operated only in the tilting directions.

(I) The set switch $SW_A$ and the select switch $SW_B$ are disabled from simultaneously entering the ON state by forming the stopper 12 on the base 10. The invention may be applied also to a device in which no stopper is disposed so that a set switch and a select switch can simultaneously enter the ON state.

(J) The axes of the support shafts 18 and the rotation shafts 31 for supporting the operation lever in a tiltable manner intersect each other at one point and at right angles. According to the invention, the supporting and rotation shafts may be so configured that their axes intersect each other and respectively pass two different positions that are separated in the longitudinal direction of the operation lever.

(K) For supporting the bearing unit 20 on the base 10, there is described support shafts 18 formed on the base 10 and bearing holes 21 formed in the bearing unit 20. According to the invention, the device may be so configured that the bearing holes are formed in the base and the supporting shafts on the bearing unit.

(L) For supporting the tilting unit 30 on the bearing unit 20, there is provided shaft fitting holes 22 formed in the bearing unit 20 and rotation shafts 31 formed on the tilting unit 30. According to the invention, the device may be so configured that the rotation shafts are formed on the bearing unit and the shaft fitting holes in the tilting unit.

The invention is not restricted to the embodiments described above and shown in the drawings. Various modifications can be made without departing from the spirit and scope of the invention.

Figure 8:
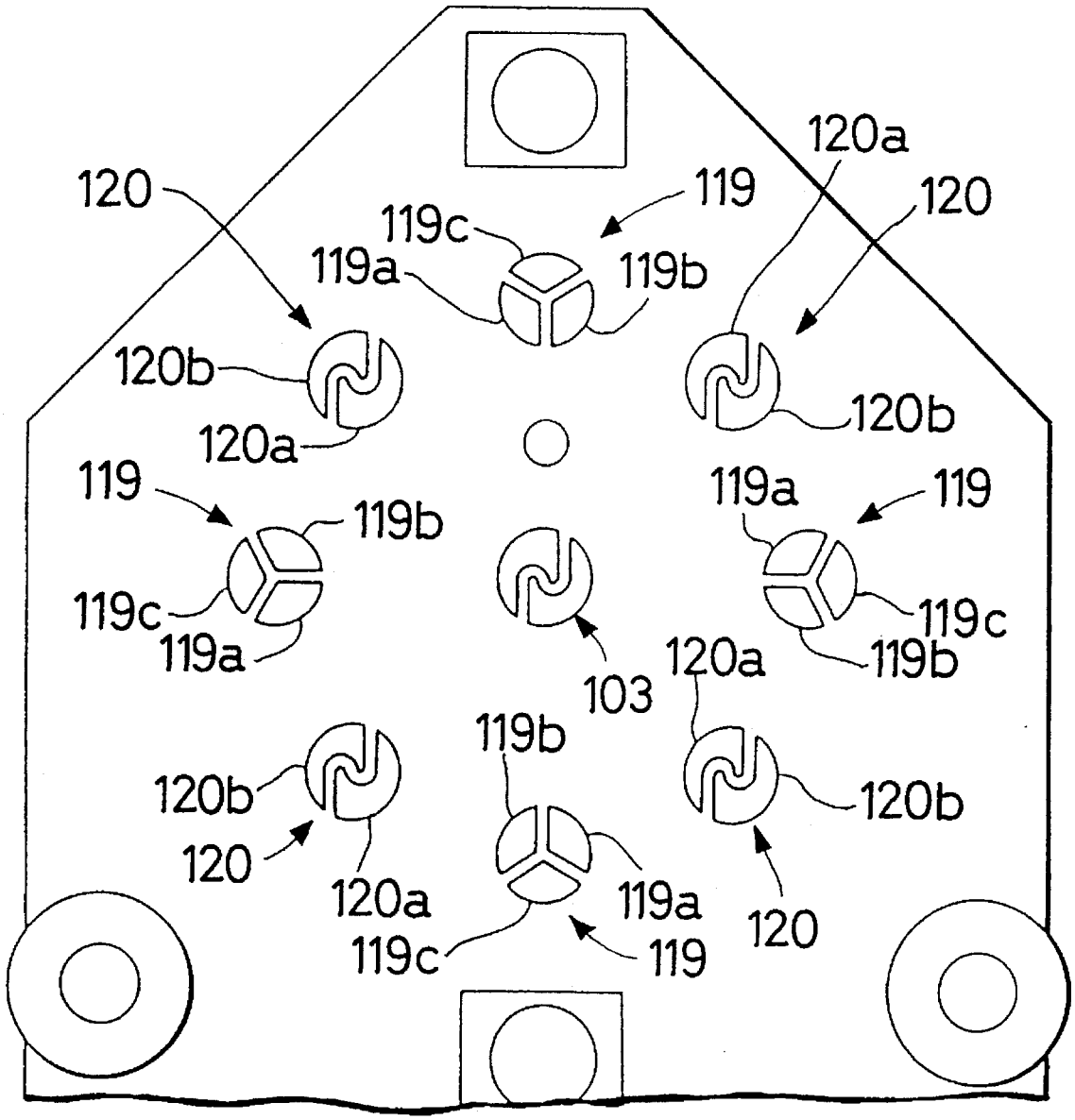
FIG. 8 is a plan view of a printed board and showing stationary contacts of an embodiment of the invention.
Figure 9:
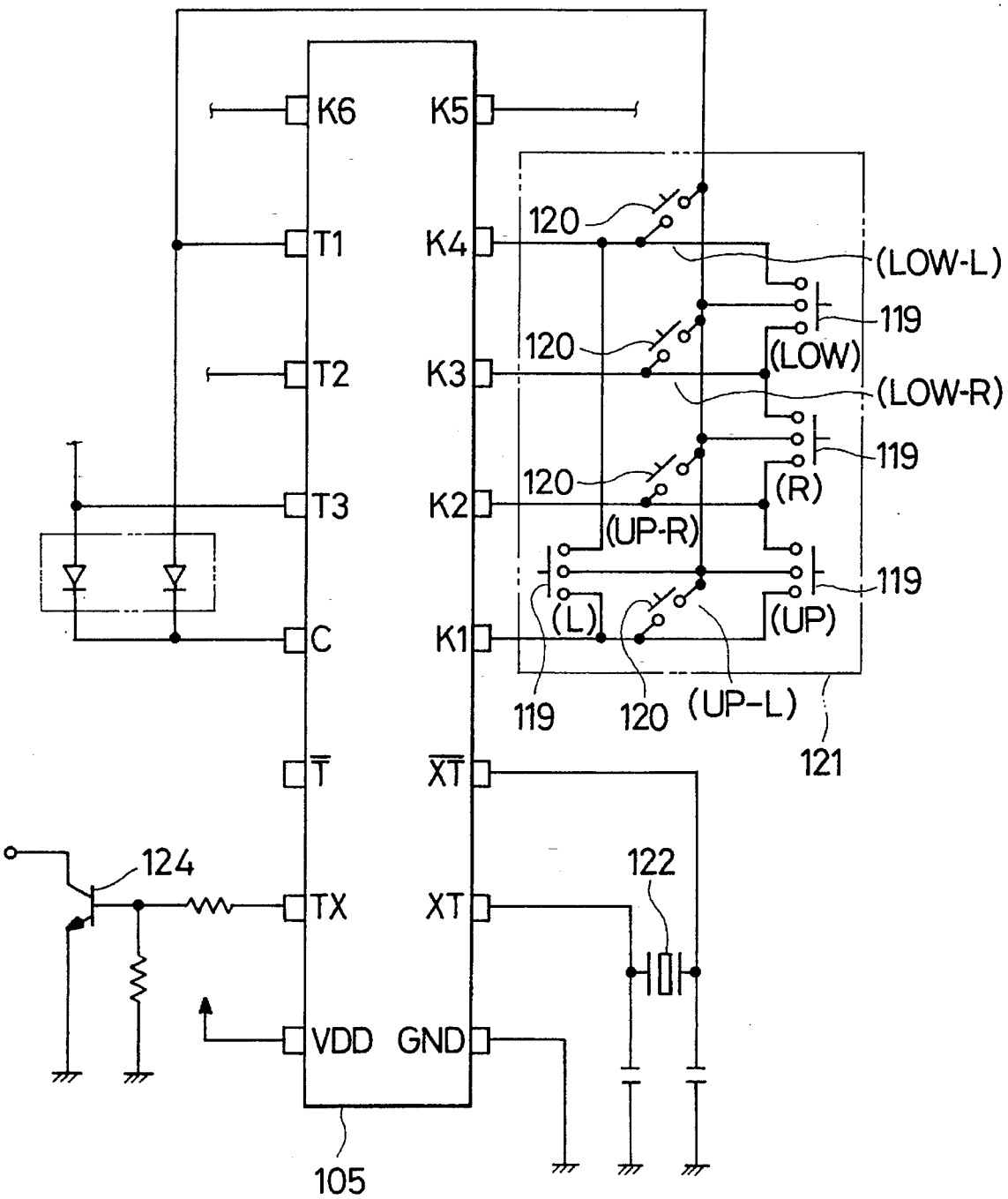
FIG. 9 is a circuit diagram showing a switch matrix circuit of the embodiment of the invention.
Figure 10A:
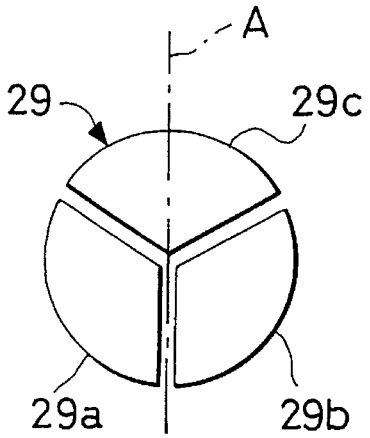
FIGS. 10(*a*)–(*f*) are plan views showing arrangements of stationary contacts of a select switch having two circuits and three contacts.
Figure 10B:
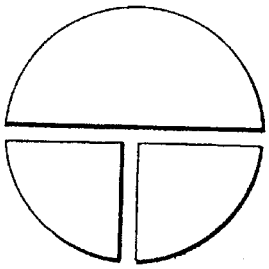
Figure 10C:
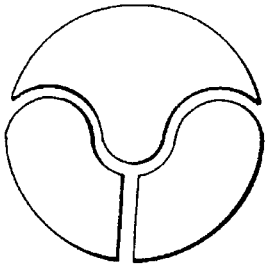
Figure 10D:
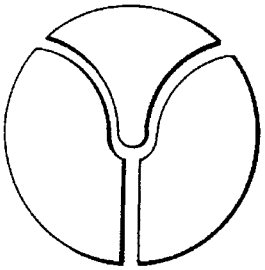
Figure 10E:
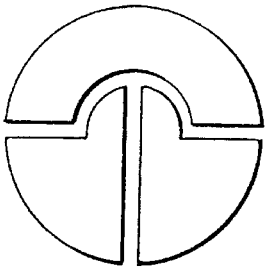
Figure 10F:
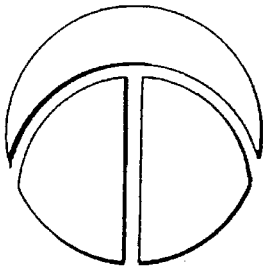

Hereinafter, a switch matrix circuit for a lever switch device, such as a joystick switch applicable in a controller of a car navigation system, will be described with reference to FIGS. 8 to 9.

The arrangement pattern of the stationary contacts 3*a* and 3*b* for the select switches $SW_A$ and $SW_B$ will be described with reference to FIG. 8. In the group of the eight select switches $SW_B$ arranged at regular angular intervals, select switches 119 respectively corresponding to the four directions, i.e., the upper, lower, left, and right directions (which refer to the tilt directions of the operation lever 40), each include three stationary contacts 119*a*, 119*b*, and 119*c* having a shape obtained by dividing a circle into three equal parts. Two stationary contacts 119*a* and 119*b* are located symmetrically on both sides of a line passing through the select switch 119 and the set switch 103. The other stationary contact 119*c* is located in the outer side with respect to the stationary contacts 119*a* and 119*b*. These stationary contacts 119*a*, 119*b*, and 119*c* and the short-circuit conductor 8 constitute a 2-circuit and 3-contact switch in which the stationary contact 119*c* is used as a common line. Four select switches 120 respectively positioned between the above-described four select switches 119 correspond to the four oblique directions, i.e., the upper right, lower right, lower left, and upper left directions. Each select switch 120 includes two stationary contacts 120*a* and 120*b*. The stationary contacts 120*a* and 120*b* and the short-circuit conductor 8 constitute a 1-circuit and 2-contact switch.

Next, the electric construction is described. As shown in FIG. 9, the eight select switches 119 and 120 are interconnected into a matrix form, so as to constitute a switch matrix circuit 121 that is connected to the remote control IC 105.

In the structure of the lever switch device, when the lever is tilted in any one direction and one switch corresponding to the direction is activated, digital data is output. The output is a logical OR of digital data output when switches adjacent to the one switch are activated.

For example, it is assumed that the relationship between the tilt direction of the lever and digital data from the switch matrix circuit is preset as shown in Table 2 below. When the switch positioned on the upper side is activated, "1100" is output. When the switch positioned on the upper left side is activated, "1000" is output. When the switch positioned on the upper right side is activated, "0100" is output.

TABLE 2

| State of SW | t1 | d1 | d2 | d3 | d4 |
|---|---|---|---|---|---|
| Upper is ON | 1 | 1 | 1 | 0 | 0 |
| Upper left is ON | 1 | 1 | 0 | 0 | 0 |
| Left is ON | 1 | 1 | 0 | 0 | 1 |
| Lower left is ON | 1 | 0 | 0 | 0 | 1 |
| Lower is ON | 1 | 0 | 0 | 1 | 1 |
| Lower right is ON | 1 | 0 | 0 | 1 | 0 |
| Right is ON | 1 | 0 | 1 | 1 | 0 |
| Upper right is ON | 1 | 0 | 1 | 0 | 0 |

Herein, the upper left direction and the upper right direction are adjacent to the upper direction. The data "1100" assigned to the upper direction is the logical OR of the data "1000" assigned to the upper left direction and the data "0100" assigned to the upper right direction.

Accordingly, for example, when the lever is tilted in a direction between the upper side and the upper left side, and the switches positioned on the upper side and the upper left side are simultaneously activated, the data "1100" output when the switch on the upper side is pressed and the data "1000" output when the switch on the upper left side is pressed are simultaneously output. Because the d1 bits are equal to each other, the data "1100" is eventually output from the switch matrix circuit. When the switch on the upper side and the switch on the upper left side are simultaneously pressed, therefore, it is judged that the switch on the upper side is pressed, and no abnormal operation is caused. Moreover, when the lever is tilted in a direction between the upper side and the upper right side, it is judged that the switch on the upper side is pressed in the same way as described above. Thus, no abnormal operation is caused.

In the invention, the term "logical OR" refers to a logical OR in a broad sense. In positive logic, it has the same meaning as a logical OR in a narrow sense, and, in negative logic, it has the same meaning as a logical AND in a narrow sense. For example, if the data output when the switch positioned on the upper left side is pressed is "0111" in the negative logic and the data output when the switch positioned on the upper right side is pressed is "1011", the data output when the switch positioned on the upper side may be the logical AND "0011" of these two data in the narrow sense.

In addition the logical OR state of data is produced by utilizing 2-circuit switches and therefore the circuitry can be simplified. Moreover, when adjacent switches are simultaneously pressed, it is always judged that one of the switches that is more frequently used is pressed, thereby attaining a further effect that the device can be operated without producing the sense of incongruity.

The remote control IC 105 includes 6-bit input terminals K1–K6 (in the embodiment, K1–K4 are used) capable of receiving parallel digital data. Digital data input therethrough are converted into a serial data code by a converter (not shown) in the remote control IC. The serial data code is output through a transmitting terminal Tx. Output terminals T1–T3 (in the embodiment, T1 is used) are provided for indicating that the input terminals K1–K6 are enabled to receive digital data. At predetermined timings, timing signals t1–t3 having a logical value "1" (in the embodiment, t1 is used) are output from the output terminals T1–T3, respectively. A clock generator (not shown) is disposed in the remote control IC 105, to control the timing of the inner circuits, and is externally connected to a ceramic oscillator 122.

Next, the switch matrix circuit 121 is described. The stationary contact 119*a* positioned on the inner side of the select switch 119 for the upper direction, and the stationary contact 120*a* of the select switch 120 for the upper left direction are connected to the data input terminal K1 of the remote control IC 105. The other stationary contact 119*b*, and the stationary contact 120*a* of the select switch 120 for the upper right direction are connected to the data input terminal K2. In addition, the stationary contact 119*c* positioned on the outer side, and the other stationary contacts 120*b* of the select switches 120 for the upper left direction and the upper right direction are connected to the output terminal T1 of the remote control IC 105. As a result, the switch circuits of the select switch 119 positioned on the upper side are connected in parallel to the switch circuits of the select switches 120 positioned on both sides. Similarly, the remaining select switches 119 for the lower, left and right directions are connected so that their switch circuits are in parallel with those of the select switches 120 positioned on both sides.

If the knob portion 42 of the operation lever 40, which is in the neutral state, is tilted in the upper direction, the operation lever 40 and the tilting holder 30 are tilted. Thus, the operation pin 16 positioned in the tilt direction is pressed by the flange 32 of the holder, and the switch operating unit 5 is pressed by the operation pin 16 and elastically deformed. As shown in FIG. 6, the short-circuit conductor 8 of the deformed switch operating unit 5 contacts the stationary contacts 119*a*, 119*b*, and 119*c* of the select switch 119 positioned on the upper side. As a result, the two stationary contacts 119*a* and 119*b* positioned on the inner side and the stationary contact 119*c* positioned on the outer side are short-circuited, so as to establish electric continuity therebetween, whereby the respective switch circuits establish the ON state.

When the timing signal t1 ("1") is output from the terminal T1 of the remote control IC 105, the logical value "1" is output from the stationary contacts 119*a* and 119*b* of the select switch 119 positioned on the upper side, and is then input into the input terminals K1 and K2 of the remote control IC 105. At this time, the input terminals K3 and K4 that receive nothing are pulled down by resistors in the remote control IC 105, so that the terminals K3 and K4 have a value "0". Thus, digital data "1100" is input to the input terminals K1–K4 of the remote control IC 105. Then, the data input into the remote control IC 5 is converted into a serial data code that indicates that the select switch 119 positioned on the upper side is pressed. The data code is output from the transmitting terminal Tx to be transmitted via a buffer 124. In the same way, when another one of the select switches 119 and 120 is pressed, respective digital data is output in the relationship shown in Table 2.

The operation lever 40 can be tilted in any desired direction, including directions in which two adjacent select switches 119 and 120 may be simultaneously pressed. When the select switch 119 for the upper direction and the select switch 120 for the upper left direction are simultaneously pressed, for example, digital data "1100" as the result of the pressing of the select switch 119 positioned in the upper direction, and digital data "1000" as the result of the pressing of the select switch 20 positioned in the upper left direction are output. In this case, both the d1 bits are "1", so that digital data "1100" indicating that the select switch 119 for the upper direction is pressed is output from the switch matrix circuit 121. Therefore, when the select switch 119 for the upper direction and the select switch 120 for the upper left direction are simultaneously pressed, it is judged that the select switch 119 for the upper direction is pressed. In this way, abnormal operation cannot be caused because it is never judged that two select switches are pressed. In another case where the operation lever 117 is tilted in a direction between the upper direction and the upper right direction, and the select switches 119 and 120 positioned in the upper direction and the upper right direction are simultaneously pressed, digital data "1100" is output in the same way as described above. Thus, it is judged that the select switch 119 for the upper direction is pressed, so that abnormal operation is not caused.

As described above, in the embodiment, even when adjacent select switches 119 and 120 are simultaneously pressed, it is judged that only one of the switches, i.e., the select switch 119 is pressed. Thus, abnormal operation cannot be caused. In addition, the strokes in respective directions can be set in a similar way, so that it is possible to improve the operability of the operation lever 117.

Because the logical OR state of digital data is produced by utilizing the select switches 119 each including two circuits and three contacts, the circuitry can be simplified. Even in the case where adjacent select switches 119 and 120 are simultaneously pressed, it is always judged that one of the select switches 119 positioned in the upper, lower, left, and right directions which are more frequently used is pressed. Thus, it is possible to operate the device without producing incongruity.

When the connecting operations of the switch circuits are observed in detail, it is noted that the operation pin 15 is obliquely pressed from the outer side by the flange 32 of the tilting holder 30, and therefore moves toward the lower side while tilting the upper end portion to the inner side, thereby elastically deforming the switch operating unit 5 from the inner side. The short-circuit conductor 8 makes contact with the formation areas on the printed board 2 starting from the inner side, and the contact gradually progresses to the outer side. Consequently, the two stationary contacts 119*a* and 119*b* positioned in the inner side (and connected to branch lines) are first short-circuited, and thereafter the two stationary contacts 119*a* and 119*b* and the remaining stationary contact 119*c* (connected to a common line) are short-circuited. The circuits formed by connecting 119*a* and 119*c*, and 119*b* and 119*c* are established at the same time.

Assuming that the period between the pressing operation on the operation pin 16 and the connection operation of the switch circuit consisting of the stationary contacts 119*a* and 119*c* due to the short-circuit of the two stationary contacts is largely different from that between the pressing operation and the connection operation of the switch circuit consisting of the stationary contacts 119*b* and 119*c*, there may arise a case where, when the timing signal t1 is output, one of the switch circuits has entered the connection state but the other switch circuit has not yet entered the connection state. In this case, the switch matrix circuit 121 outputs parallel data "1000". The data is converted into the data code indicating that the select switch 120 for the upper left direction is pressed, and then transmitted. When the other switch circuit thereafter enters the ON state, the correct parallel data "1100" is output in response to the output of the next timing signal t1, and the data is converted into the data code indicating that the select switch 119 for the upper direction is pressed, to be transmitted.

As described above, in the select switch 119 having two circuits and three contacts, a difference in timing between the ON operations of the two switch circuits causes a phenomenon in which incorrect, parallel data, different from that indicative of the currently pressed select switch 119, is first output and thereafter, the correct parallel data is output.

However, the two stationary contacts 119*a* and 119*b* are first short-circuited, and thereafter the two stationary contacts and the remaining stationary contact 119*c* are short-circuited. Hence, the two switch circuits (i.e., 119*a* and 119*c*, and 119*b* and 119*c*) enter the connection state at the exact same time, so that there occurs no difference in timing between the ON operations of the two switch circuits, whereby the phenomenon in which incorrect parallel data is first output is prevented from occurring. Accordingly, an apparatus controlled by the joystick of the embodiment is free from erroneous operation.

The stationary contacts 119*a*, 119*b*, and 119*c* of the select switch 119 having two circuits and three contacts have a shape obtained by dividing a circle into three equal parts. However, the shape of the contacts can be modified in various manners without departing the spirit of the invention. For example, depending on the particular application and environment, the contacts have shapes as shown in FIGS. 10(*a*)–10(*f*). As long as one of the stationary contacts that is connected to the common line is located in a contact terminate area (disposed furthest away from the center of the operation lever in the neutral position), and the other stationary contacts that are connected to branch lines are located in the contact start area or an area other than the area in which the stationary contact connected to the common line is disposed, erroneous output is prevented from occurring.

In the embodiment, the movable short-circuit conductor 8 is made of an electrically conductive rubber material. The material of the conductor, however, is not restricted to rubber material. Even when the embodiment is variously modified, for example, a conductor made of an electrically conductive metal plate, the conductor can be considered a movable short-circuit conductor.

The invention has been described in detail with reference to the drawings, which are meant to be illustrative but not limiting. Various modifications are possible without departing from the spirit and scope of the invention as defined in the appended claims.

What is claimed is:

1. A lever switch device, comprising:

an operation lever movable from a neutral position to one of a pressing position and one of a plurality of tilting positions;

first switch means for being activated when said operation lever is in the pressing position;

second switch means for being activated when said operation lever is in one of said plurality of tilting positions; and operation restricting means for preventing movement of said operation lever into said pressing position when in said one of said plurality of tilting positions while allowing movement of said operation lever among said plurality of tilting positions without moving through said neutral position and for preventing movement of said operation lever into any one of said plurality of tilting positions when said operation lever is in the pressing position.

2. A lever switch device according to claim 1, wherein said operation restricting means comprises an enlarged portion radially extending and integrally formed with said operation lever, and a base having a stopper for supporting said operation lever, said stopper being in close relation with said enlarged portion when the operation lever is in one of the pressing position and one of said plurality of tilting positions, and wherein movement of said operation lever from one of the pressing and one of said plurality of tilting positions directly to the other of the pressing and one of said plurality of tilting positions is inhibited by abutment of said enlarged portion against said stopper.

3. The lever switch device according to claim 2, wherein the enlarged portion comprises a knob and an integrally formed umbrella-like portion, said knob being depressable for activating said first switch means in the pressing position, and tiltable for activating said second switch means in one of said tilting positions.

4. The lever switch according to claim 3, wherein the umbrella-like portion cooperates with a housing such that movement of the operation lever from the neutral position to one of said tilting positions causes the umbrella-like portion to slide along the housing.

5. A lever switch device according to claim 2, further comprising a tilting unit, said tilting unit having an aperture of noncircular cross-sectional shape in which said operation lever is disposed, said tilting unit being supported in a tiltable manner, thereby allowing said operation lever to be positioned in the pressing position.

6. A lever switch device according to claim 1, further comprising a tilting unit supported in a tiltable manner and having a throughhole of noncircular cross-sectional shape in which said operation lever is disposed, said operation lever having a noncircular cross-sectional shape.

7. A lever switch device according to claim 1, wherein said operation restricting means allows movement of said operation lever toward said pressing position when said operation lever is in one of said plurality of tilting positions.

8. A method for selectively activating a first switch and at least one of a plurality of second switches with an operation lever, the method comprising:

moving said operation lever from a neutral position to one of a pressing position to activate said first switch and one of a plurality of tilting positions to activate at least one of the plurality of second switches; and restricting movement of said operation lever to prevent the operation lever from moving from one of the pressing and a tilting position to the other one of the pressing and a tilting position without first moving to the neutral position, while allowing said operation lever to move among said plurality of tilting positions without moving through the neutral position.

9. The method of claim 8, further comprising inhibiting simultaneous movement of the operation lever to the pressing and tilting positions.

10. A lever-type switch activation device, comprising:

an operation lever movable from a neutral position to a tilted position;

a tilting unit supporting said operation lever and being rotatably supported about a first shaft having a first shaft axis; and a bearing unit supporting said tilting unit, said bearing unit being rotatably supported about a second shaft having a second shaft axis whereby said operation lever is simultaneously tiltable about said first shaft axis and said second shaft axis.

11. A lever switch device according to claim 10, wherein axes of said first and second shafts intersect each other at right angles.

12. A lever switch device according to claim 11, wherein said operation lever is supported on said tilting unit so as to pass through said tilting unit in such a manner that said operation lever is relatively movable angularly and in a direction perpendicular to said first and second shaft axes, and said operation lever is pressable longitudinally in a direction perpendicular to said first and second shaft axes.

13. A lever switch device according to claim 12, wherein a portion of said operation lever where said operation lever passes through said tilting unit has a noncircular cross-sectional shape.

14. A lever switch device according to claim 10, wherein said operation lever is supported on said tilting unit so as to pass through said tilting unit in such a manner that said operation lever is relatively movable angularly and in a direction perpendicular to said first and second shaft axes, and said operation lever is pressable in a direction perpendicular to said first and second shaft axes.

15. A lever switch device according to claim 14, wherein a portion of said operation lever where said operation lever passes through said tilting unit has a noncircular cross-sectional shape.

16. A multi-direction lever-type switch activation device, comprising:

a lever tiltable in multiple directions; and a switch matrix circuit including a plurality of switches activated in accordance with a tilt direction of said lever, said switch matrix circuit outputting digital data indicating one of the plurality of switches that is activated in accordance with the tilt direction of said lever;

said switch matrix circuit being constructed so that digital data is output based on activating one of a first set of switches despite simultaneous activation of a second set of switches that is adjacent to said first set of switches.

17. A multi-direction lever switch device according to claim 16, wherein each switch of said first set of switches is a 2-circuit switch having two circuits and three contacts in which said two circuits are one of simultaneously opened and closed, and each switch of said second set of switches is a 1-circuit switch having one circuit and two contacts, said two circuits of said 2-circuit switch being connected in parallel with said one circuit of said 1-circuit switch.

18. A multi-direction lever switch device according to claim 17, wherein each of said first set of switches is assigned to a direction in which said first set of switches is more frequently activated than said second set of switches.

19. A multi-direction lever switch device according to claim 16, wherein each of said first set of switches is assigned to a direction in which said first set of switches is more frequently activated than the second set of switches.

20. A method for outputting data signals from first and second sets of adjacent switches activated by a tiltable lever, the method comprising:

tilting the lever to activate at least one of each of the first and second sets of switches; and outputting said data signals based on activation of one of the first set of switches despite simultaneous activation of one of the second set of switches.

21. The method of claim 20, further comprising outputting said data based on activation of one of the second set of switches only when no switch in the first set of switches is activated.

22. The method of claim 20, further comprising assigning the first set of switches to respective directions that are more frequently activated than directions assigned to the second set of switches.

23. A switch element for selectively and simultaneously connecting a common line to a plurality of branch lines, comprising:

a plurality of stationary contacts, each of said stationary contacts having a flat stationary contacting surface, said plurality of stationary contacts arranged whereby respective ones of said flat stationary contacting surfaces are disposed in a common plane; and a movable short-circuit conductor having a flat contacting surface and opposed to said plurality of stationary contacts, whereby a simultaneous connection is established between said movable short-circuit conductor and said plurality of stationary contacts while tilting an operation lever, said connection progressing in a sequence from a contact start area to a predetermined contact terminate area;

one of said plurality of stationary contacts being connected to said common line and disposed in said contact terminate area, and a remainder of the plurality of stationary contacts being connected to said plurality of branch lines and disposed in the contact start area.

24. A switch element according to claim 23, wherein said stationary contacts connected to said branch lines are dividedly disposed so that one branch line contact is disposed on each side of a line that extends from said contact start area to said contact terminate area.

25. A method for connecting a common line to a plurality of branch lines, the method comprising:

providing a plurality of stationary contacts, each of said stationary contacts having a flat stationary contacting surface, said plurality of stationary contacts arranged whereby respective ones of said flat stationary contacting surfaces are disposed in a common plane;

connecting a first of the stationary contacts to the common line and a remainder of the stationary contacts to respective ones of said branch lines;

placing a movable conductor having a flat contacting surface and being in opposed relation to said stationary contacts, the movable conductor being adapted to establish a simultaneous connection with the stationary contacts, said connection progressing in a sequence from a contact start area to a contact terminate area;

disposing the first stationary contact in the contact terminate area, and the remainder of the stationary contacts in the contact start area; and connecting the remainder of the stationary contacts in the contact start area with each other, and simultaneously connecting the remainder of the stationary contacts in the contact start area to the first stationary contact in the contact terminate area.

* * * * *